US007388457B2

(12) United States Patent
Pance et al.

(10) Patent No.: US 7,388,457 B2
(45) Date of Patent: Jun. 17, 2008

(54) DIELECTRIC RESONATOR WITH VARIABLE DIAMETER THROUGH HOLE AND FILTER WITH SUCH DIELECTRIC RESONATORS

(75) Inventors: Kristi Dhimiter Pance, Auburndale, MA (US); Eswarappa Channabasappa, Acton, MA (US)

(73) Assignee: M/A-COM, Inc., Lowell, MA (US)

( * ) Notice: Subject to any disclaimer, the term of this patent is extended or adjusted under 35 U.S.C. 154(b) by 265 days.

(21) Appl. No.: 11/038,977

(22) Filed: Jan. 20, 2005

(65) Prior Publication Data

US 2006/0186972 A1 Aug. 24, 2006

(51) Int. Cl.
*H01P 1/20* (2006.01)

(52) U.S. Cl. ..... 333/202; 333/219.1

(58) Field of Classification Search ..... 333/202, 333/219.1

See application file for complete search history.

(56) References Cited

U.S. PATENT DOCUMENTS

| | | | | |
|---|---|---|---|---|
| 3,475,642 | A | 10/1969 | Karp et al. | 315/3.5 |
| 4,028,652 | A | 6/1977 | Wakino et al. | |
| 4,138,652 | A | 2/1979 | Nishikawa et al. | 333/82 R |
| 4,267,537 | A | 5/1981 | Karmel | 333/231 |
| 4,283,649 | A | 8/1981 | Heinouchi | 310/324 |
| 4,423,397 | A | 12/1983 | Nishikawa et al. | 333/202 |
| 4,459,570 | A | 7/1984 | Delaballe et al. | 333/202 |
| 4,477,785 | A | 10/1984 | Atia | 333/202 |
| 4,506,241 | A * | 3/1985 | Makimoto et al. | 333/222 |
| 4,578,655 | A | 3/1986 | Etienne et al. | 333/202 |
| 4,620,168 | A | 10/1986 | Delestre et al. | 333/202 |
| 4,661,790 | A | 4/1987 | Gannon et al. | 333/234 |
| 4,757,289 | A | 7/1988 | Kosugi et al. | 333/209 |
| 4,810,984 | A | 3/1989 | Arnold et al. | 333/202 |
| 4,821,006 | A | 4/1989 | Ishikawa et al. | 333/202 |
| 4,835,498 | A | 5/1989 | Rouger et al. | 333/205 |
| 4,881,051 | A | 11/1989 | Tang et al. | 333/208 |
| 5,059,929 | A | 10/1991 | Tanaka | 333/219.1 |
| 5,109,207 | A | 4/1992 | Aizawa et al. | 333/222 |
| 5,136,270 | A * | 8/1992 | Hatanaka et al. | 333/219.1 |
| 5,140,285 | A | 8/1992 | Cohen | 331/96 |
| 5,218,330 | A | 6/1993 | Omiya et al. | 333/223 |
| 5,347,246 | A * | 9/1994 | Bellows et al. | 333/219.1 |
| 5,525,945 | A | 6/1996 | Chiappetta et al. | 333/202 |
| 5,614,875 | A | 3/1997 | Jang et al. | 333/202 |

(Continued)

FOREIGN PATENT DOCUMENTS

EP 0 492 304 A1 7/1992

(Continued)

OTHER PUBLICATIONS

M. A. Gerdine, "A Frequency-Stabilized Microwave Band-Rejection Filter Using High Dielectric Constant Resonators", IEEE Transactions on Microwave Theory and Techniques, vol. MTT-17, No. 7. Jul. 1969, pp. 354-359.

(Continued)

*Primary Examiner*—Benny Lee

(57) ABSTRACT

In accordance with the principles of the present invention, a dielectric resonator is provided with a longitudinal through hole with a diameter that varies as a function of height of the resonator so as to increase the frequency spacing between the fundamental mode and the spurious modes.

28 Claims, 13 Drawing Sheets

U.S. PATENT DOCUMENTS

| | | | | |
|---|---|---|---|---|
| 5,691,677 | A | 11/1997 | De Maron et al. | 333/219.1 |
| 5,748,058 | A | 5/1998 | Scott | 333/202 |
| 5,777,534 | A | 7/1998 | Harrison | 333/202 |
| 5,841,330 | A | 11/1998 | Wenzel et al. | 333/202 |
| 5,859,574 | A | 1/1999 | Schmitt | 333/202 |
| 5,949,309 | A | 9/1999 | Correa | 333/202 |
| 5,990,767 | A | 11/1999 | Ivanov et al. | 333/219.1 |
| 6,069,105 | A * | 5/2000 | Yamamoto et al. | 501/153 |
| 6,087,910 | A | 7/2000 | Matsumoto et al. | 333/202 |
| 6,100,703 | A | 8/2000 | Davidov et al. | 324/631 |
| 6,111,339 | A | 8/2000 | Ohya et al. | 310/358 |
| 6,208,227 | B1 | 3/2001 | Remillard et al. | 333/219 |
| 6,254,708 | B1 | 7/2001 | Cappabianca | 156/89.12 |
| 6,262,639 | B1 | 7/2001 | Shu et al. | 333/202 |
| 6,337,664 | B1 | 1/2002 | Mayes et al. | 343/749 |
| 6,356,170 | B1 | 3/2002 | Arakawa et al. | 333/208 |
| 6,402,981 | B1 | 6/2002 | Sasaki | 252/62.9 PZ |
| 6,707,353 | B1 | 3/2004 | Yamakawa et al. | 333/202 |
| 6,717,490 | B1 | 4/2004 | Mayer | 333/202 |
| 6,784,768 | B1 | 8/2004 | Pance et al. | 333/219 |
| 2004/0051602 | A1 | 3/2004 | Pance et al. | 333/202 |
| 2004/0051603 | A1 | 3/2004 | Pance et al. | 333/202 |

FOREIGN PATENT DOCUMENTS

| | | | |
|---|---|---|---|
| EP | 0 601 370 | A1 | 6/1994 |
| EP | 1 102 344 | A2 | 5/2001 |
| EP | 1 119 069 | A | 7/2001 |
| EP | 1 162 684 | A3 | 12/2001 |
| EP | 1 181 740 | B1 | 3/2003 |
| GB | 1 376 938 | | 12/1974 |
| GB | 1 520 473 | | 8/1978 |
| JP | 57-014202 | A | 1/1982 |
| JP | 59-202701 | | 11/1984 |
| JP | 363280503 | A | 11/1988 |
| JP | 01-144701 | | 6/1989 |
| JP | 02-042898 | A | 2/1990 |
| JP | 02-137502 | | 5/1990 |
| JP | 02-168702 | | 6/1990 |
| JP | 05-102714 | | 4/1993 |
| JP | 05-267940 | | 10/1993 |
| JP | 06-061714 | | 3/1994 |
| JP | 07-154114 | A | 6/1995 |
| JP | 07-154116 | | 6/1995 |
| JP | 03-249803 | | 9/2003 |
| WO | WO 00/70706 | | 11/2000 |
| WO | WO 01/43221 | | 6/2001 |
| WO | WO 2004/027917 | | 4/2004 |

OTHER PUBLICATIONS

S. Verdeyme & P. Guillon, "New Direct Coupling Configuration Between $TE_{01\delta}$ Dielectric Resonator Modes" Electronics Letters, May 25, 1989, vol. 25 No. 11, pp. 693-694.

T. Nishikawa et al., "Dielectric High-Power Bandpass Filter Using Quarter-Cut $TE_{01\delta}$ Image Resonator for Cellular Base Stations", IEEE Transactions on Microwave Theory and Techniques, vol. MTT-35, No. 12, Dec. 1987 pp. 1150-1155.

Hui et al. "Dielectric Ring-Gap Resonator for Application in MMIC's" IEEE Transactions on Microwave Theory and Techniques vol. 39, No. 12, Nov. 1991.

D. Kajfez and P. Guillon "Dielectric Resonators", ISBN 0-89006-201-3, Publisher Artech House, Dedham, MA 1986, pp. 298-317.

E. J. Heller, "Quantum Proximity Resonances", Physical Review Letters, vol. 77, No. 20, Nov. 11, 1966 The American Physical Society , pp. 4122-4125.

K. Pance et al., "Tunneling Proximity Resonances: Interplay Between Symmetry and Dissipation", Physics Department, Northwestern University Aug. 2, 1999, T-143, pp. 16-18, F426.

Kishk et al., "Conical Dielectric Resonator Antennas for Wide-Band Applications," IEEE Transactions on Antennas and Propogation 50(4); 469-474 (2002).

* cited by examiner

DIELECTRIC RESONATOR WITH VARIABLE DIAMETER THROUGH HOLE AND FILTER WITH SUCH DIELECTRIC RESONATORS

FIELD OF THE INVENTION

The invention pertains to dielectric resonators, such as those used in microwave circuits for concentrating electric fields, and to the circuits made from them, such as microwave filters.

BACKGROUND OF THE INVENTION

Dielectric resonators are used in many circuits, particularly microwave circuits, for concentrating electric fields. They can be used to form filters, combline filters, oscillators, triplexers, and other circuits. The higher the dielectric constant of the dielectric material out of which the resonator is formed, the smaller the space within which the electric fields are concentrated. Suitable dielectric materials for fabricating dielectric resonators are available today with dielectric constants ranging from approximately 10 to approximately 150 (relative to air). These dielectric materials generally have a mu (magnetic constant, often represented as $\mu$) of 1, i.e., they are transparent to magnetic fields.

FIG. 1 is a perspective view of a typical cylindrical or doughnut-type dielectric resonator of the prior art that can be used to build dielectric resonator circuits, such as filters. As can be seen, the resonator 10 is formed as a cylinder 12 of dielectric material with a circular, longitudinal through hole 14. Individual resonators are commonly called "pucks" in the relevant trade. While dielectric resonators have many uses, their primary use is in connection with microwave circuits and particularly, in microwave communication systems and networks.

As is well known in the art, dielectric resonators and resonator filters have multiple modes of electrical fields and magnetic fields concentrated at different frequencies. A mode is a field configuration corresponding to a resonant frequency of the system as determined by Maxwell's equations. In a typical dielectric resonator circuit, the fundamental resonant mode, i.e., the field having the lowest frequency, is the transverse electric field mode, $TE_{01}$ (or TE, hereafter). The electric field of the TE mode is circular and is oriented transverse of the cylindrical puck 12. It is concentrated around the circumference of the resonator 10, with some of the field inside the resonator and some of the field outside the resonator. A portion of the field should be outside the resonator for purposes of coupling between the resonator and other microwave devices (e.g., other resonators or input/output couplers) in a dielectric resonator circuit.

It is possible to arrange circuit components so that a mode other than the TE mode is the fundamental mode of the circuit and, in fact, this is done sometimes in dielectric resonator circuits. Also, while typical, there is no requirement that the fundamental mode be used as the operational mode of a circuit, e.g., the mode within which the information in a communications circuit is contained.

The second mode (i.e., the mode having the second lowest frequency) normally is the hybrid mode, $H_{11\delta}$ (or $H_{11}$ mode hereafter). The next lowest-frequency mode that interferes with the fundamental mode usually is the transverse magnetic or $TM_{01\delta}$ mode (hereinafter the TM mode). There are additional higher order modes. Typically, all of the modes other than the fundamental mode, e.g., the TE mode, are undesired and constitute interference. The $H_{11}$ mode, however, typically is the only interference mode of significant concern. However, the TM mode sometimes also can interfere with the TE mode, particularly during tuning of dielectric resonator circuits. The remaining modes usually have substantial frequency separation from the TE mode and thus do not cause significant interference or spurious response with respect to the operation of the system. The $H_{11}$ mode and the TM mode, however, can be rather close in frequency to the TE mode and thus can be difficult to separate from the TE mode in operation. In addition, as the bandwidth (which is largely dictated by the coupling between electrically adjacent dielectric resonators) and center frequency of the TE mode are tuned, the center frequency of the TE mode and the $H_{11}$ mode move in opposite directions toward each other. Thus, as the TE mode is tuned to increase its center frequency, the center frequency of the $H_{11}$ mode inherently moves downward and, thus, closer to the TE mode center frequency. The TM mode typically is widely spaced in frequency from the fundamental TE mode when the resonator is in open space. However, when metal is close to the resonator, such as would be the case in many dielectric resonator filters and other circuits which use tuning plates near the resonator in order to tune the center of frequency of the resonator, the TM mode drops in frequency. As the tuning plate or other metal is brought closer to the resonator, the TM mode drops extremely rapidly in frequency and can come very close to the frequency of the fundamental TE mode.

FIG. 2 is a perspective view of a microwave dielectric resonator filter 20 of the prior art employing a plurality of dielectric resonators 10*a*, 10*b*, 10*c*, and 10*d*. The resonators 10*a*, 10*b*, 10*c*, 10*d* are arranged in the cavity 22 of an enclosure 24. Microwave energy is introduced into the cavity via a coupler 28 coupled to a cable, such as a coaxial cable. Conductive separating walls 32*a*, 32*b*, 32*c*, 32*d* separate the resonators from each other and block (partially or wholly) coupling between physically adjacent resonators 10*a*, 10*b*, 10*c*, 10*d*. Particularly, irises 30*a*, 30*b*, 30*c* in walls 32*b*, 32*c*, 32*d*, respectively, control the coupling between adjacent resonators 10*a*, 10*b*, 10*c*, 10*d*. Walls without irises generally prevent any coupling between adjacent resonators. Walls with irises allow some coupling between adjacent resonators. By way of example, the field of resonator 10*a* couples to the field of resonator 10*b* through iris 30*a*, the field of resonator 10*b* further couples to the field of resonator 10*c* through iris 30*b*, and the field of resonator 10*c* further couples to the field of resonator 10*d* through iris 30*c*. Wall 32*a*, which does not have an iris, prevents the field of resonator 10*a* from coupling with physically adjacent resonator 10*d* on the other side of the wall 32*a*. Conductive adjusting screws may be placed in the irises to further affect the coupling between the fields of the resonators and provide adjustability of the coupling between the resonators, but are not shown in the example of FIG. 2.

One or more metal plates 42 may be attached by screws 27 to the top wall (not shown for purposes of clarity) of the enclosure to affect the field of the resonator and help set the center frequency of the filter. Particularly, screws 27 may be rotated to vary the spacing between the plate 42 and the resonator 10*a*, 10*b*, 10*c*, 10*d* to adjust the center frequency of the resonator. An output coupler 40 is positioned adjacent the last resonator 10*d* to couple the microwave energy out of the filter 20 and into a coaxial connector (not shown). Signals also may be coupled into and out of a dielectric resonator circuit by other methods, such as microstrips positioned on the bottom surface 28 of the enclosure 24 adjacent the resonators. The sizes of the resonator pucks 10*a*, 10*b*, 10*c*, 10*d*, their relative spacing, the number of pucks, the size of the cavity 22, and the size of the irises 30*a*, 30*b*, 30*c* all need to be precisely controlled to set the desired center frequency of the filter and the bandwidth of the filter. More specifically, the bandwidth of the filter is controlled primarily by the amount of coupling of the electric and magnetic fields between the electrically adjacent resonators. Generally, the closer the resonators are to each other, the more coupling between them and the wider the bandwidth of the filter. On the other hand, the center frequency of the filter is controlled largely by the sizes of the resonators themselves and the sizes of the conductive plates 42 as well as the distance of the plates 42 from their corresponding resonators 10*a*, 10*b*, 10*c*, 10*d*. Generally, as the resonator gets larger, its center frequency gets lower.

Prior art resonators and the circuits made from them have many drawbacks. For instance, prior art dielectric resonator circuits such as the filter shown in FIG. 2 suffer from poor quality factor, Q, due to the presence of many separating walls and coupling screws. Q essentially is an efficiency rating of the system and, more particularly, is the ratio of stored energy to lost energy in the system. The fields generated by the resonators pass through all of the conductive components of the system, such as the enclosure 24, plates 42, internal walls 32*a*, 32*b*, 32*c*, 32*d* and adjusting screws 27, and inherently generate currents in those conductive elements. Those currents essentially comprise energy that is lost to the circuit.

Furthermore, the volume and configuration of the conductive enclosure 24 substantially affects the operation of the system. The enclosure minimizes radiative loss. However, it also has a substantial effect on the center frequency of the TE mode. Accordingly, not only must the enclosure usually be constructed of a conductive material, but also it must be very precisely machined to achieve the desired center frequency performance, thus adding complexity and expense to the fabrication of the system. Even with very precise machining, the design can easily be marginal and fail specification.

Even further, prior art resonators tend to have poor mode separation between the TE mode and the $H_{11}$ and/or TE modes.

Accordingly, it is an object of the present invention to provide improved dielectric resonators.

It is another object of the present invention to provide improved dielectric resonator circuits.

It is a further object of the present invention to provide dielectric resonator circuits with improved mode separation and spurious response.

SUMMARY OF THE INVENTION

In accordance with principles of the present invention, a dielectric resonator is provided with a longitudinal through hole of variable cross section (e.g., diameter). The cross section (i.e., the section taken perpendicular to the longitudinal direction) varies as a function of height (i.e., the longitudinal direction) and may vary abruptly (i.e., stepped), linearly (e.g., conical), or otherwise. The diameter of the through hole is selected at any given height so as to remove dielectric material at the height where the spurious modes primarily exist and to leave material at the height where the fundamental mode is concentrated.

The invention can be implemented in connection with conventional cylindrical resonators, but is preferably employed in connection with conical resonators, which tend to physically separate the fundamental mode from the spurious modes better than conventional cylindrical resonators and thus allow for superior ability to remove dielectric material where spurious modes are concentrated without simultaneously removing dielectric material where the fundamental mode is concentrated.

DETAILED DESCRIPTION OF THE INVENTION

U.S. patent application Ser. No. 10/268,415, which is fully incorporated herein by reference, discloses new dielectric resonators as well as circuits using such resonators. One of the key features of the new resonators disclosed in the aforementioned patent application is that the field strength of the TE mode field outside of and adjacent the resonator varies along the longitudinal dimension of the resonator. As disclosed in the aforementioned patent application, a key feature of these new resonators that helps achieve this goal is that the cross-sectional area of the resonator measured parallel to the field lines of the TE mode varies along the longitude of the resonator, i.e., perpendicularly to TE mode field lines. In one embodiment, the cross-section varies monotonically as a function of the longitudinal dimension of the resonator, i.e., the cross-section of the resonator changes in only one direction (or remains the same) as a function of height. In one preferred embodiment, the resonator is conical, as discussed in more detail below. Preferably, the cone is a truncated cone.

Figure 13:
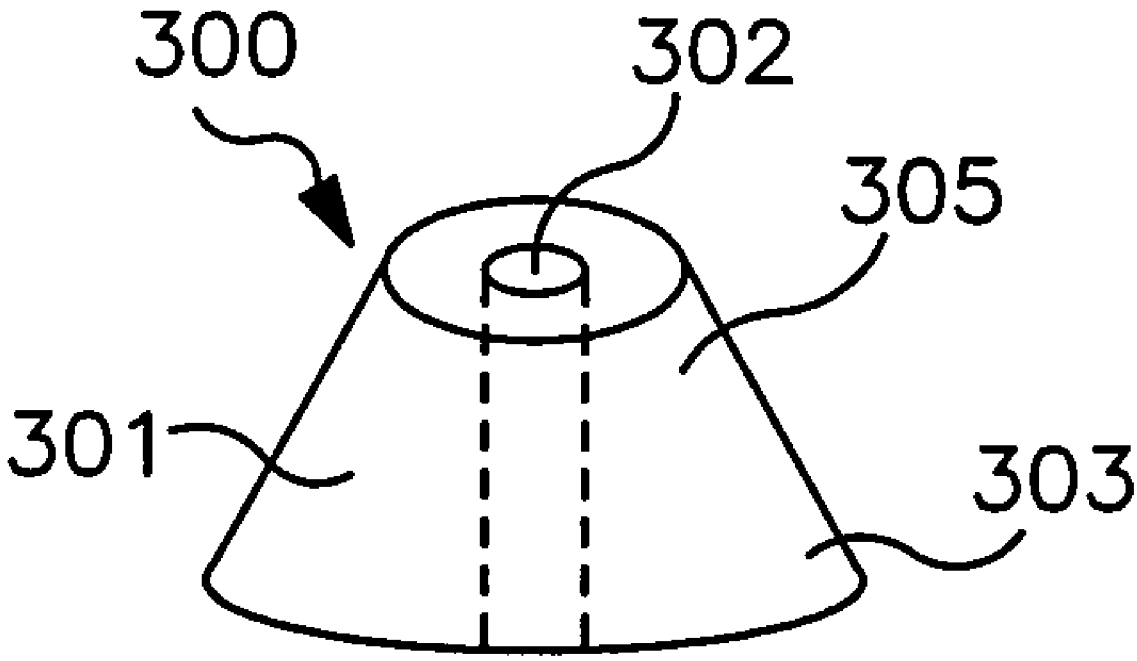
FIG. 13 RELATED ART
FIG. 13 is a perspective view of a truncated conical resonator in which the principles of the present invention can be used to particular advantage.

FIG. 13 is a perspective view of an exemplary embodiment of a dielectric resonator disclosed in the aforementioned patent application. As shown, the resonator 300 is formed in the shape of a truncated cone 301 with a central, longitudinal through hole 302. This design has many advantages over conventional, cylindrical dielectric resonators, including physical separation of the $H_{11}$ mode from the TE mode and/or almost complete elimination of the $H_{11}$ mode. Specifically, the TE mode electric field tends to concentrate in the base 303 of the resonator while the $H_{11}$ mode electric field tends to concentrate at the top 305 (narrow portion) of the resonator. The longitudinal displacement of these two modes improves performance of the resonator (or circuit employing such a resonator) because the conical dielectric resonators can be positioned adjacent other microwave devices (such as other resonators, microstrips, tuning plates, and input/output coupling loops) so that their respective TE mode electric fields are close to each other and therefore strongly couple, whereas their respective $H_{11}$ mode electric fields remain further apart from each other and, therefore, do not couple to each other nearly as strongly, if at all. Accordingly, the $H_{11}$ mode would not couple to the adjacent microwave device nearly as much as in the prior art, where the TE mode and the $H_{11}$ mode are physically located much closer to each other.

In addition, the mode separation (i.e., frequency spacing between the modes) is increased in a conical resonator. Even further, the top of the resonator may be truncated to eliminate much of the portion of the resonator in which the $H_{11}$ mode field would be concentrated, thereby substantially attenuating the strength of the H11 mode.

Figure 1:
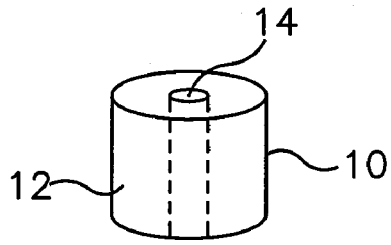
FIG. 1 PRIOR ART
FIG. 1 is a perspective view of an exemplary conventional cylindrical dielectric resonator.
Figure 2:
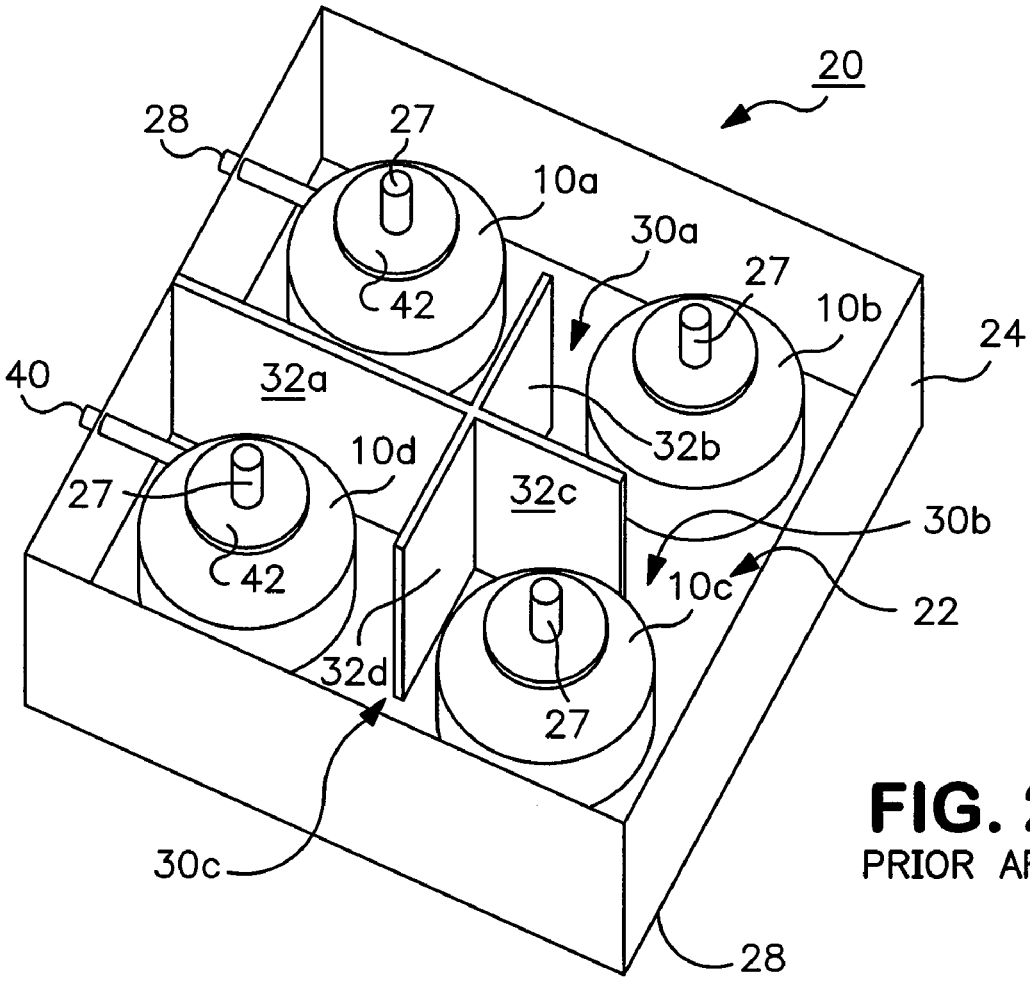
FIG. 2 PRIOR ART
FIG. 2 is a perspective view of an exemplary conventional microwave dielectric resonator filter circuit.

The concepts of the present invention are particularly useful when used in connection with conical resonators such as illustrated in FIG. 13 and disclosed in U.S. patent application Ser. No. 10/268,415, but also are applicable to more conventional cylindrical resonators, such as illustrated in FIG. 1. In accordance with the concepts of the present invention, the central longitudinal through hole of a dielectric resonator is shaped so as to remove even more dielectric material in the volumes where the spurious modes primarily exist. By doing so, the spurious modes can be weakened. However, more significantly, the frequency separation of those spurious modes from the fundamental mode is increased, thus making those spurious modes of less concern because they can be filtered out much more easily.

Figure 3B:
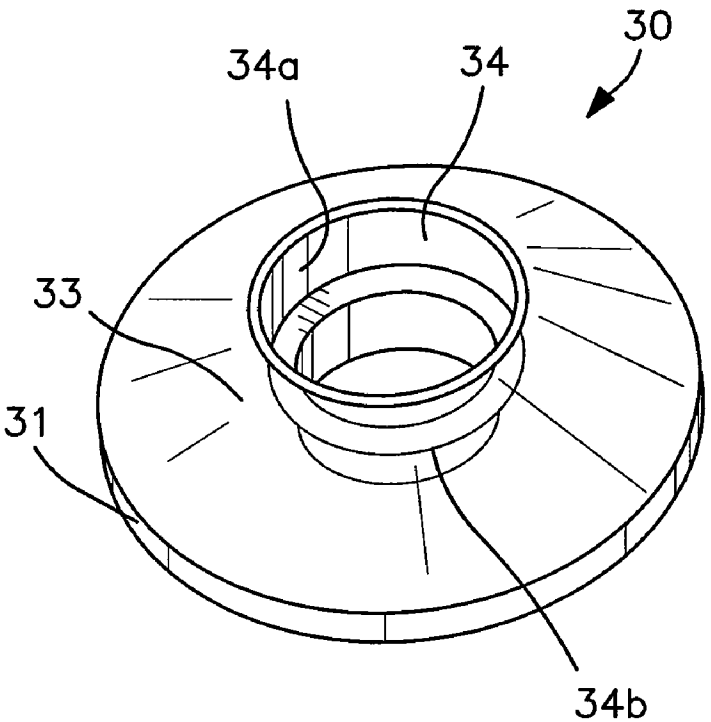
FIGS. 3A and 3B are transparent elevation and perspective views, respectively, of a dielectric resonator in accordance with a first embodiment of the invention.
Figure 3A:
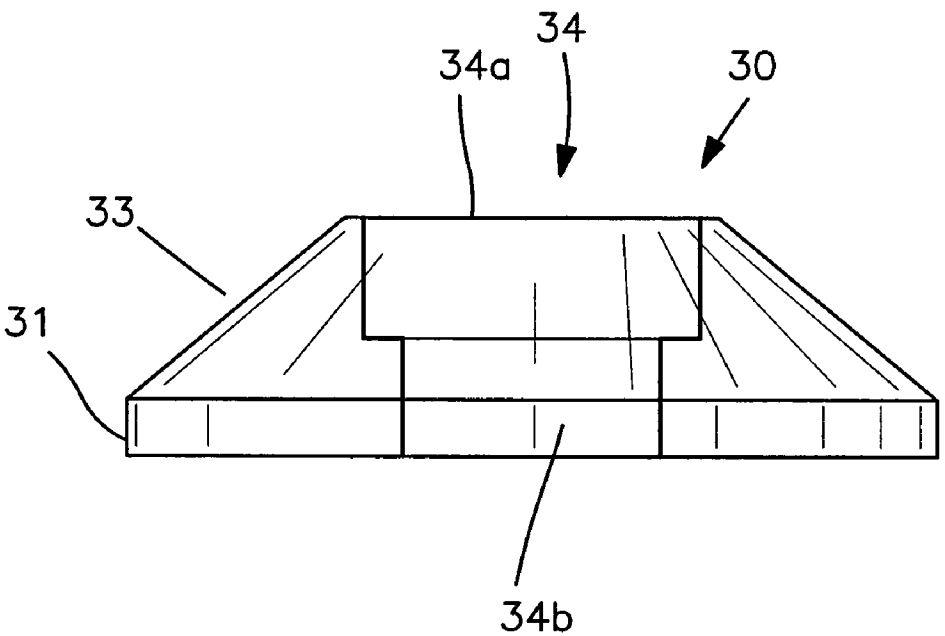

FIGS. 3A and 3B are transparent elevation and perspective views, respectively, of a dielectric resonator 30 in accordance with the first embodiment of the present invention. The resonator body is essentially conical with a small cylindrical base portion adjacent the larger longitudinal end of the conical portion of the body. It may be considered to comprise a lower cylindrical base portion 31, and an upper conical portion 33. Preferably, the height of the lower cylindrical portion 31 is relatively small compared to the height of the conical portion 33. As described in aforementioned U.S. patent application Ser. No. 10/268,415, conical dielectric resonators provide excellent physical separation of the TE and $H_{11}$ modes, with the TE mode concentrated in the lower portion of the resonator and the $H_{11}$ mode concentrated in the upper portion of the resonator. The TM mode field lines run in the longitudinal direction of the resonator orthogonal to the TE and $H_{11}$ field lines and are concentrated near the middle of the resonator.

In accordance with the invention, a single step longitudinal through hole 34 is provided comprising an upper portion 34*a* having a relatively larger cross section and a lower portion 34*b* having a relatively smaller cross section. Particularly, in the upper portion of the resonator 30, near the smaller longitudinal end of the resonator body, the cross section of the resonator body is smaller and thus the $H_{11}$ mode is concentrated there. This is where the larger diameter portion of the through hole is disposed. The larger through hole diameter provides even less dielectric material near the top of the body where the $H_{11}$ mode is concentrated. This weakens the $H_{11}$ mode field strength and increases its frequency. On the other hand, in the lower portion of the resonator adjacent the larger longitudinal end of the conical resonator body where the TE mode tends to be concentrated, the through hole has a smaller diameter, thus providing relatively more material for the TE mode and, hence, keeping its frequency low and its field strong.

The TM mode field lines tend to run through the center of the resonator in the up-down direction in FIG. 3A. Thus, making a portion of the through hole larger also removes some of the dielectric material where the TM mode is concentrated, thus also moving it up in frequency and weakening it in strength.

In a conical resonator, both the $H_{11}$ mode and the TM mode are excited close to the geometric center of the resonator, whereas the TE mode tends to be excited closer to the periphery of the conical resonator. On the other hand, in a conventional cylindrical resonator, while the TM mode still tends to be excited near the geometric center of the resonator, the $H_{11}$ mode tends to be excited closer to the periphery. If a circular tuning plate is used and is placed coaxially with the resonator, the TM mode tends to concentrate coincident with the through hole, i.e., directed in the longitudinal direction and in the middle of the resonator.

Figure 4B:
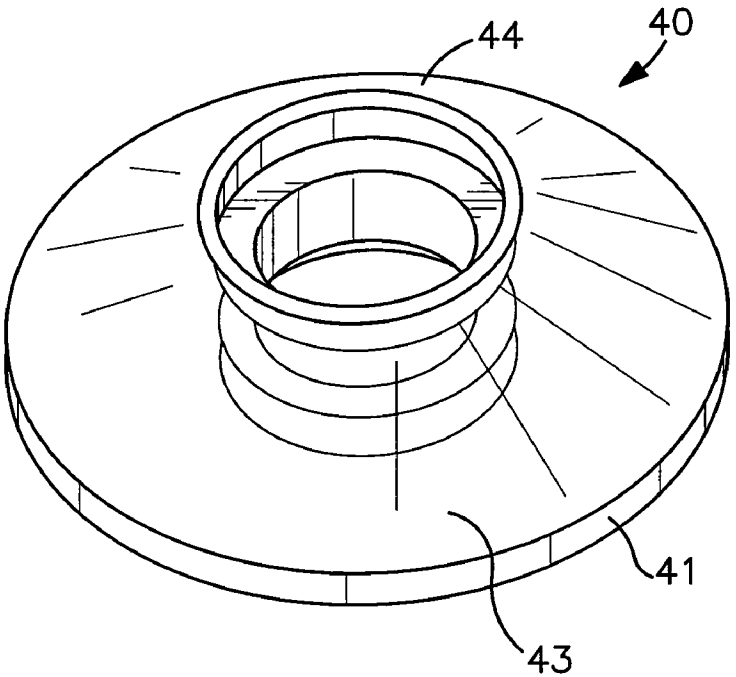
FIGS. 4A and 4B are transparent elevation and perspective views, respectively, of a dielectric resonator in accordance with a second embodiment of the invention.
Figure 4A:
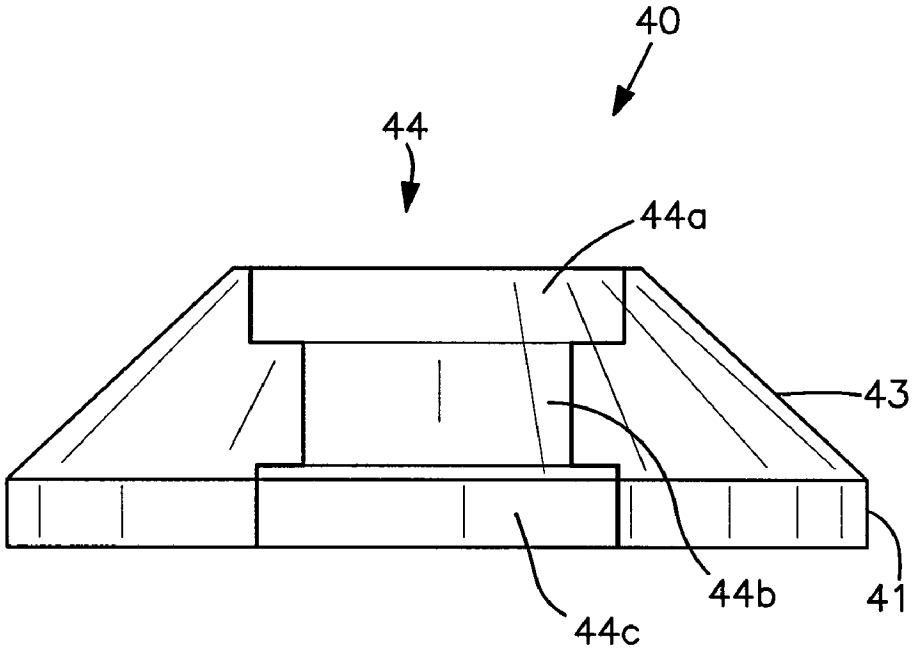

FIGS. 4A and 4B are transparent elevation and perspective views, respectively, of a dielectric resonator 40 in accordance with a second embodiment of the invention. The shape of the resonator body is essentially the same as that of resonator 30 shown in FIGS. 3A and 3B, comprising a lower cylindrical portion 41 and an upper conical portion 43. The longitudinal through hole 44, however, is different in that it comprises two steps, thus forming three portions 44*a*, 44*b*, 44*c*, comprising two larger diameter portions 44*a*, 44*c* near the upper and lower longitudinal ends of the body and a smaller diameter portion 44*b* joining them as best illustrated in FIG. 4A. This design also works well in terms of increasing mode separation between the TE mode and the $H_{11}$ and TM modes.

Figure 5B:
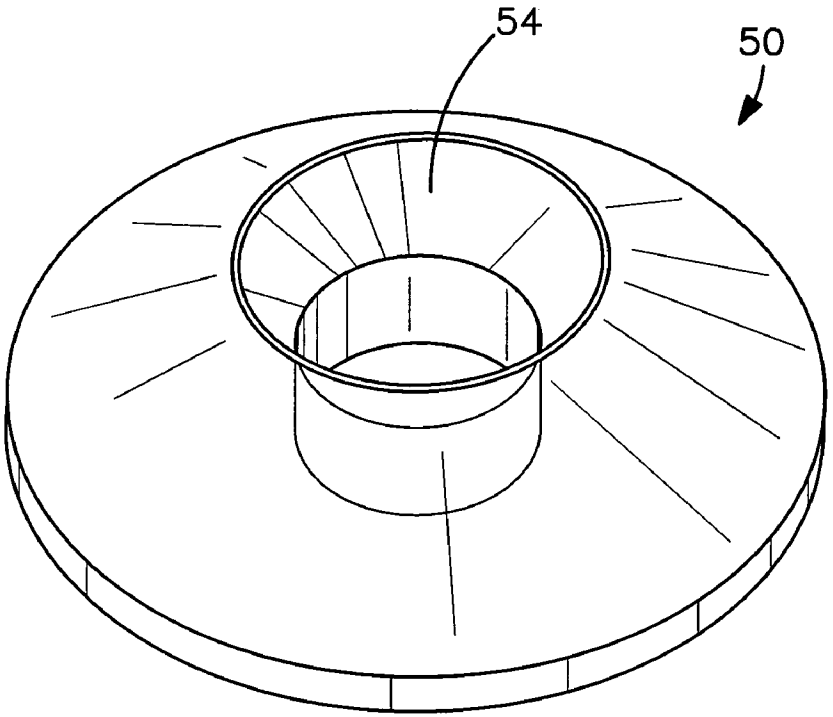
FIGS. 5A and 5B are transparent elevation and perspective views, respectively, of a dielectric resonator in accordance with a third embodiment of the invention.
Figure 5A:
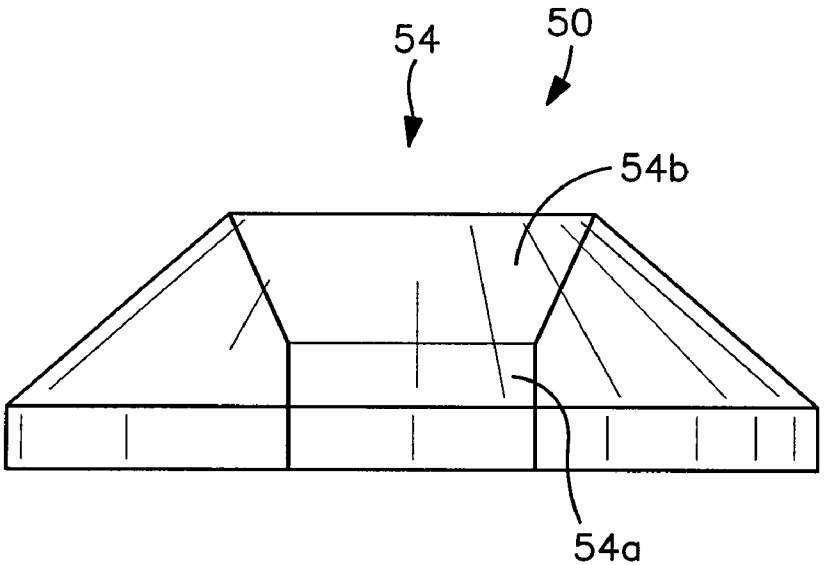

FIGS. 5A and 5B are transparent elevation and perspective views, respectively, of a dielectric resonator 50 in accordance with a third embodiment of the invention. In this embodiment, the outer surface of the resonator body is the same as in FIGS. 3A and 3B and FIGS. 4A and 4B. However, in this embodiment, the through hole 54 comprises a first, lower cylindrical portion 54*a* and a second, upper portion 54*b* that is conical in shape as best illustrated in FIG. 5A. The diameter of the conical portion 54*b* at the interface 55 where it meets the cylindrical portion of the through hole is equal in diameter to the cylindrical portion 54*a* and increases as one moves away from the interface toward the smaller longitudinal end of the resonator body. In other words, the cone defined by the conical portion of the through hole is inverted relative to the cone defined by the conical portion of the resonator body. This embodiment is particularly effective in moving the $H_{11}$ mode away in frequency from the fundamental TE mode. This design removes a significant amount of dielectric material where the $H_{11}$ mode exists.

Figure 6B:
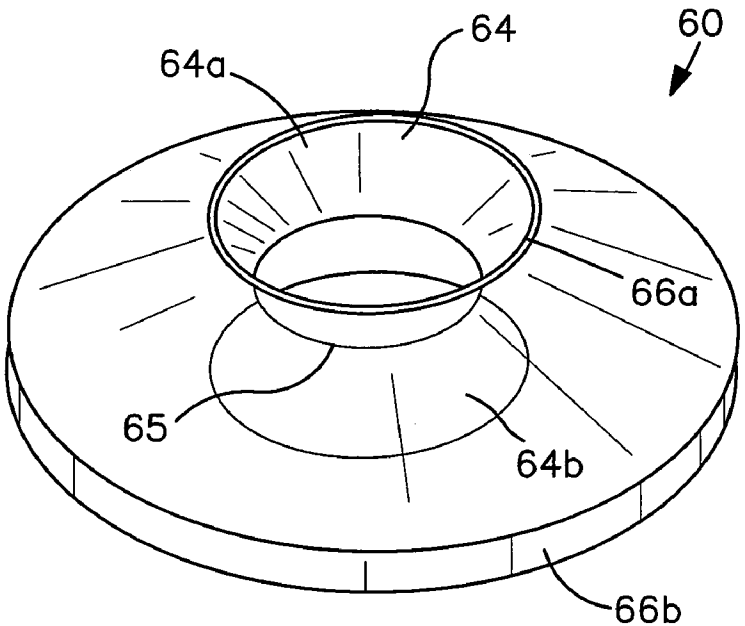
FIGS. 6A and 6B are transparent elevation and perspective views, respectively, of a dielectric resonator in accordance with a fourth embodiment of the invention.
Figure 6A:
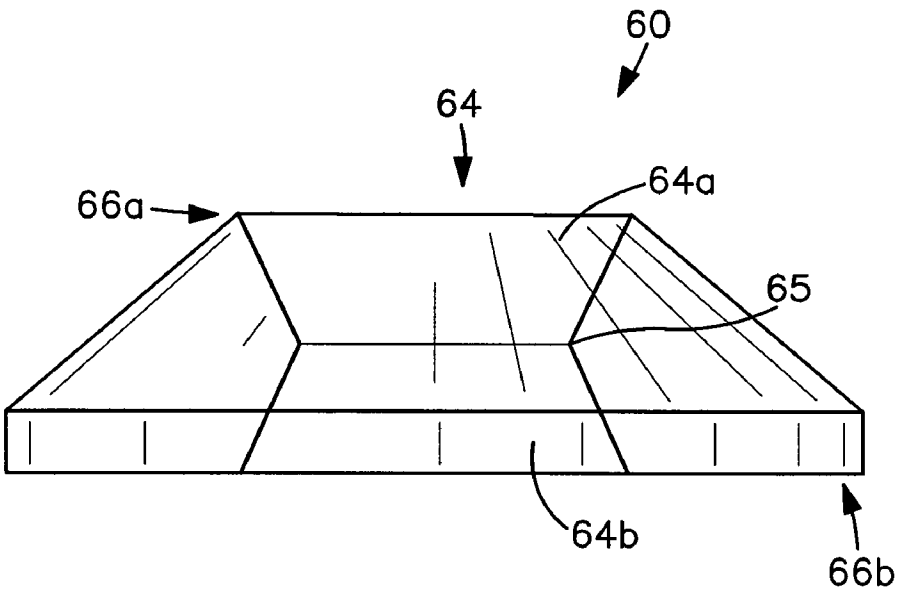

FIGS. 6A and 6B are transparent elevation and perspective views, respectively, of a dielectric resonator 60 in accordance with a fourth embodiment of the present invention. Again, the body has essentially the same outer shape as the preceding embodiments. The through hole 64 comprises two stacked conical portions 64*a*, 64*b* that are inverted relative to each other and that meet longitudinally in the center of the resonator at interface 65 and flare out as one moves longitudinally towards either longitudinal end of the resonator 66*a*, 66*b*. Like the third embodiment, this embodiment is particularly good at suppressing the $H_{11}$ and TM modes. However, the lower cone removes some material where the TE mode is concentrated and thus has the generally undesirable additional effect of pushing the TE mode up in frequency. Accordingly, this design generally would require a larger resonator for a given desired fundamental TE mode frequency than the third embodiment.

Figure 7B:
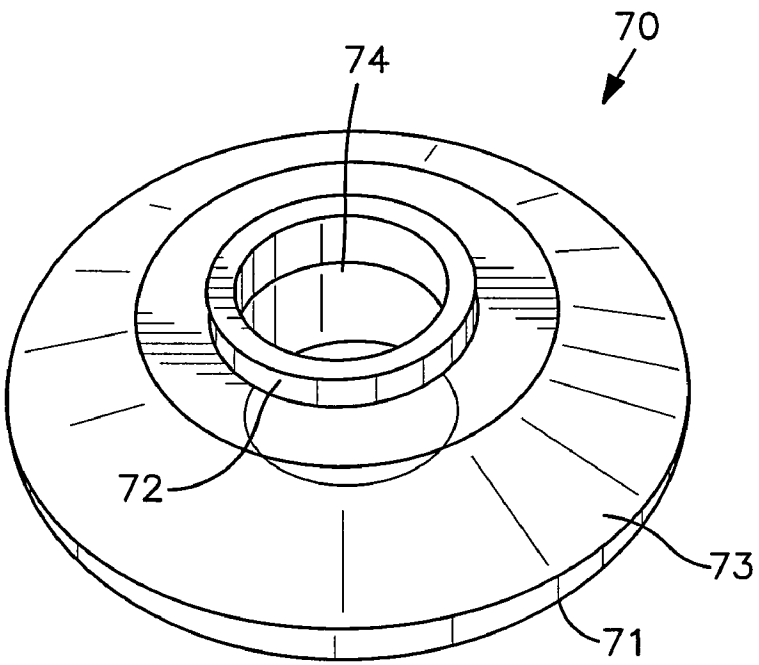
FIGS. 7A and 7B are transparent elevation and perspective views, respectively, of a dielectric resonator in accordance with a fifth embodiment of the invention.
Figure 7A:
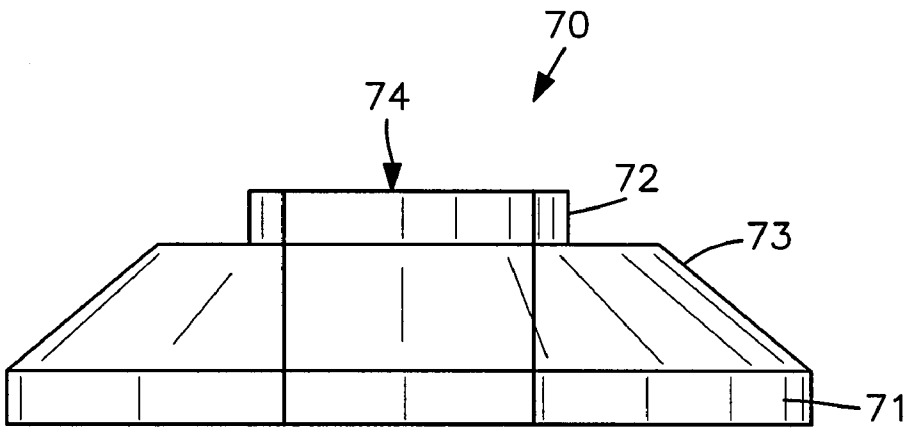

FIGS. 7A and 7B are transparent elevation and perspective views, respectively of a dielectric resonator 70, in accordance with a fifth embodiment of the present invention. In this embodiment, the through hole 74 has a constant diameter over the height of the resonator. However, the outside surface of the resonator comprises three portions, namely, a lower cylindrical portion 71, a middle conical portion 73, and an upper cylindrical portion 72. The lower cylindrical portion 71 is continuous with the conical portion 73. In other words, the diameter of the lower cylindrical portion is the same as the diameter of the base of the conical portion. However, the upper cylindrical portion 72 is stepped relative to the cone, i.e., there is an abrupt change in diameter of the outer surface of the through hole where it transitions from the conical portion 73 to the upper cylindrical portion 72. Stated another way, the diameter (or cross section) of the upper cylindrical portion 72 of the resonator body is smaller than the diameter of the upper longitudinal end of the conical portion 73 of the resonator body. This embodiment removes significant dielectric material where the $H_{11}$ mode exists. However, it generally does not remove any significant material where the TM mode exists and thus does not have much effect on the frequency of the TM mode.

Figure 8B:
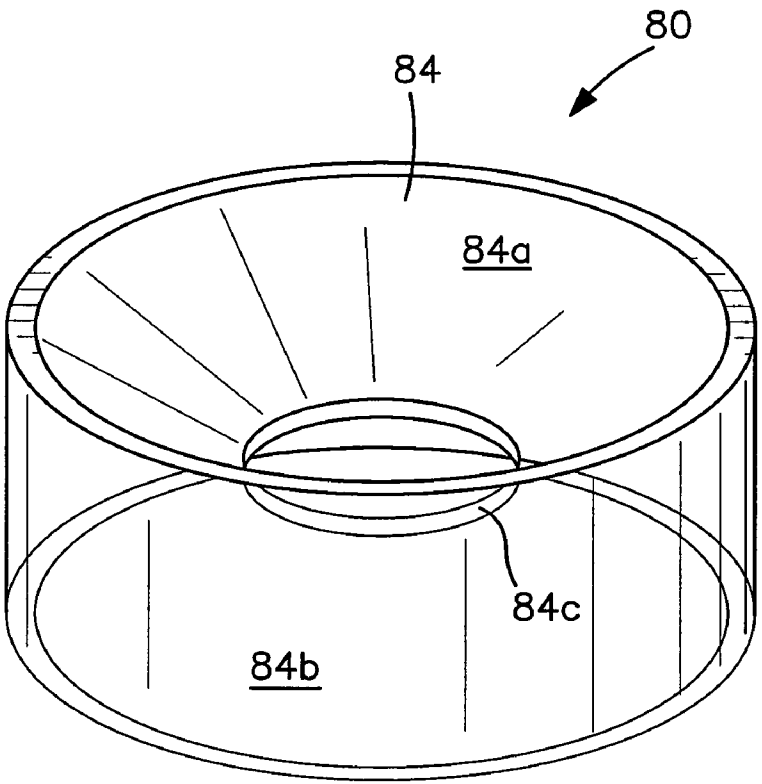
FIGS. 8A and 8B are transparent elevation and perspective views, respectively, of a dielectric resonator in accordance with a sixth embodiment of the invention.
Figure 8A:
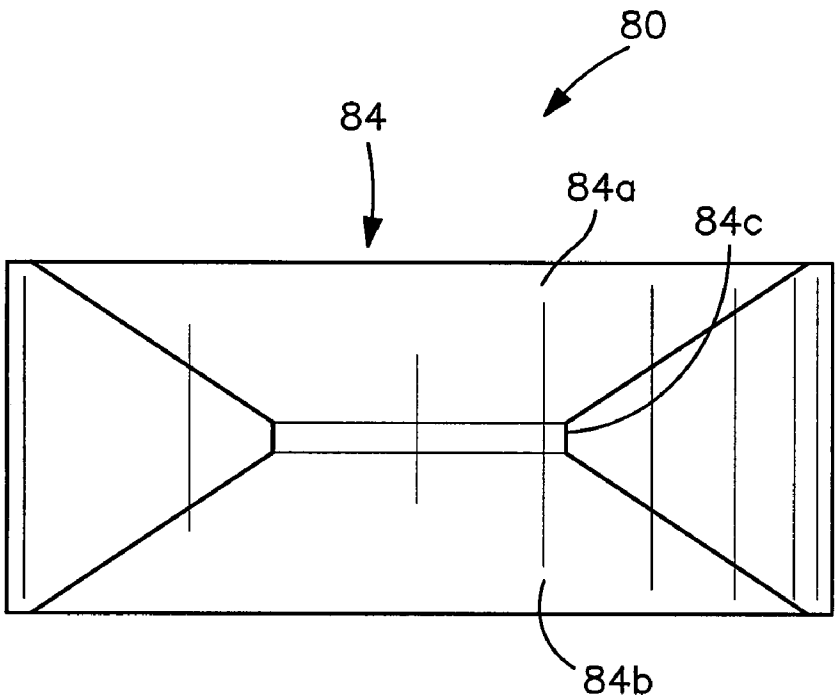

FIGS. 8A and 8B are transparent elevation and perspective views, respectively, in accordance with a sixth embodiment of the present invention. In this embodiment, the outer surface of the resonator 80 is cylindrical while the through hole 84 comprises two stacked cones 84*a*, 84*b* that are inverted relative to each other, but with a short cylindrical section 84*c* joining the two cones. The particular through hole shape here has largely the same advantages as the same through hole shape in the fifth embodiment. However, generally, cylindrical resonators have less desirable performance than conical resonators because, in cylindrical resonators, the $H_{11}$ mode and TE mode are physically closer to each other. Particularly, the $H_{11}$ mode moves closer to the periphery of the resonator body. Accordingly, it is generally more difficult to remove material where the $H_{11}$ mode primarily exists without simultaneously removing material where the TE mode exists. Furthermore, cylindrical resonators do not couple to other resonators as well as conical resonators. Accordingly, cylindrical resonators are more suited to use in circuits that comprise only a single resonator or narrow band circuits that do not require strong coupling between resonators. However, in broad band circuits or other circuits that require strong coupling between two or more resonators, conical resonators are more preferable. This applies generally and is not a limitation that is specific to the present invention.

Figure 9B:
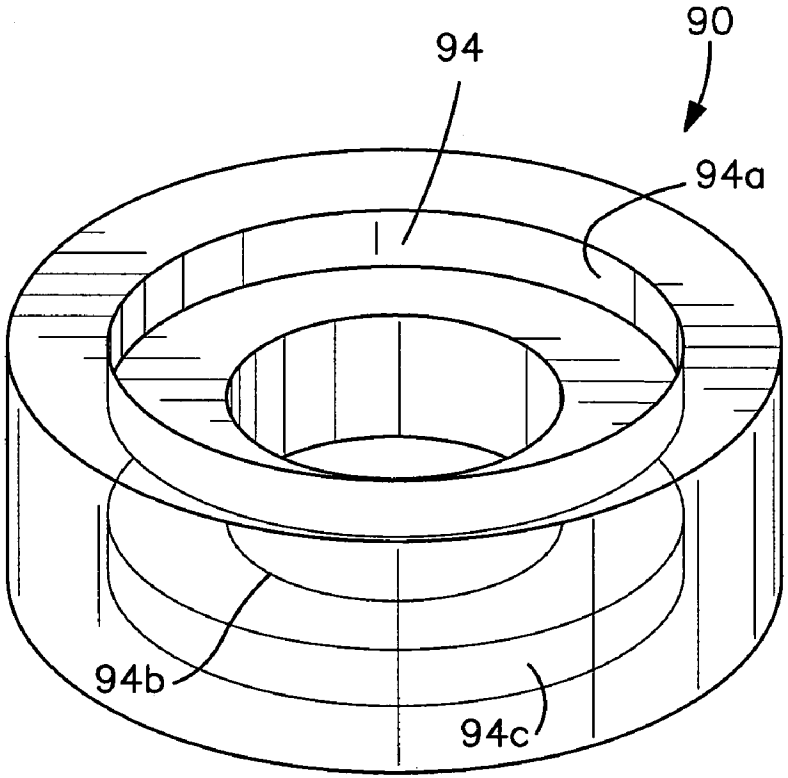
FIGS. 9A and 9B are transparent elevation and perspective views, respectively, of a dielectric resonator in accordance with a seventh embodiment of the invention.
Figure 9A:
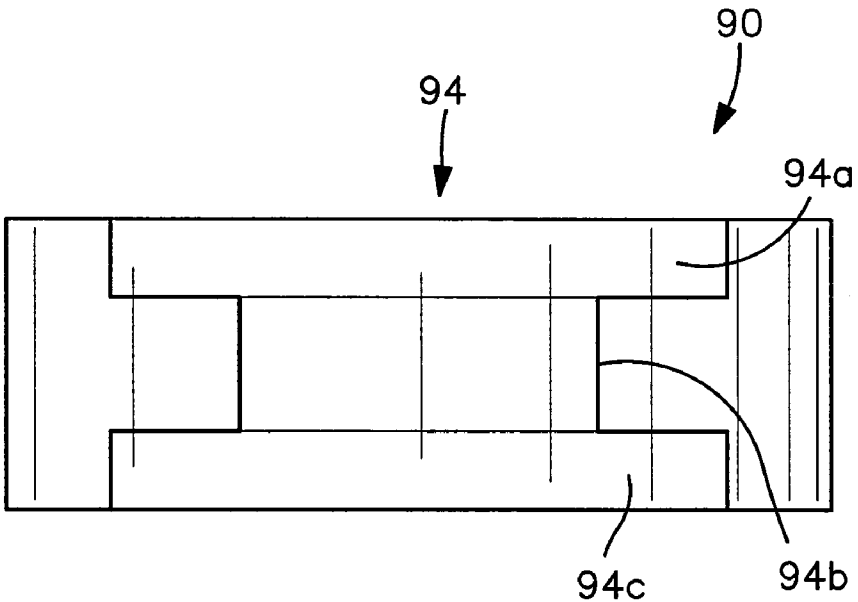

FIGS. 9A and 9B are transparent side and perspective views, respectively, of a dielectric resonator 90 in accordance with a seventh embodiment of the present invention. This embodiment is similar to the sixth embodiment except that the through hole 94, instead of comprising two cones, comprises three cylindrical portions 94*a*, 94*b*, 94*c*. Particularly, it comprises two portions 94*a*, 94*c* having larger diameters at opposite ends of the resonator connected by a smaller diameter portion 94*b* in the middle. This design has generally similar characteristics to the design of the sixth embodiment. Mode separation may be slightly less compared to the sixth embodiment. However, the advantage of this particular embodiment is that it is less expensive to manufacture than the sixth embodiment because it is more expensive to manufacture conical through holes in a dielectric resonator than stepped cylindrical through holes. Accordingly, in applications where extremely high performance in terms of mode separation and spurious response is not crucial, embodiments using stepped cylindrical through holes may be preferable due to the cost savings.

Simulations run on the HFSS Version 9.2 simulation software available from Agilent Technologies, Inc. of Palo Alto, Calif., U.S.A. were performed in order to quantify some of the benefits of the present invention. In particular, a comparison of mode separation was made between a conical resonator having an epsilon of 43 and having a through hole of constant diameter over the entire height of the resonator relative to an identical resonator with a single stepped through hole such as in the embodiments illustrated by FIGS. 3A and 3B. With the straight through hole, the fundamental TE mode existed at a center of frequency of 1,805 MHz and the center of frequency of the first hybrid $H_{11}$ mode was at 2,605 MHz. See simulation results in Appendix, pages 13-14 (last two pages). Thus, the frequency spacing between the fundamental mode and the first spurious mode was approximately 800 MHz. With the stepped through hole, the fundamental mode was at 1,843 MHz and the first $H_{11}$ mode was at 2,790 MHz. See simulation results in Appendix, pages 11-12. This is a spacing of approximately 950 MHz, which is 150 MHz greater than the single diameter through hole.

Another simulation was run on a circuit essentially identical to the two aforementioned circuits, except having a double inverted conical through hole such as in the embodiments illustrated by FIGS. 6A and 6B. With this configuration, the fundamental TE mode had a center frequency of 1,848 MHz and the $H_{11}$ mode had a center frequency of 2,716 MHz, thus providing approximately 900 MHz frequency separation between the fundamental mode and the first spurious mode. See simulation results in Appendix, pages 9-10. This is still 100 MHz greater than in the dielectric resonator having a straight through hole.

In another set of simulations, a cylindrical resonator with an epsilon of 78 and a straight through hole yielded a center frequency of 1,952 MHz for the TE mode and a center frequency of 2,686 MHz for the $H_{11}$ mode. See simulation results in Appendix, pages 7-8. Hence, the frequency separation between the fundamental mode and the first spurious mode was approximately 730 MHz. A simulation of essentially the same resonator, but with a double stepped through hole such as in the embodiments illustrated by FIGS. 4A and 4B yielded a center frequency of 2,179 MHz for the TE mode and 3,333 MHz for the first hybrid mode (which in this case was the $H_{12\delta}$ mode). See simulation results in Appendix, pages 5-6. This provides a frequency separation between the fundamental TE mode and the first spurious $H_{11}$ mode of approximately 1150 MHz. Accordingly, while this embodiment increased the center frequency of the fundamental TE mode, it more significantly increased the frequency separation between it and the first hybrid mode. Particularly, the frequency separation was increased from approximately 730 MHz to approximately 1,150 MHz.

In yet another simulation of a cylindrical resonator with an epsilon of 45 and a straight through hole, the frequency separation between the fundamental mode and the first hybrid mode was approximately 350 MHz. Particularly, the fundamental mode was centered at 1018 MHz and the first hybrid mode was centered at 1370 MHz. See simulation results in Appendix, pages 3-4. Another simulation was run on a circuit essentially identical to the aforementioned circuit, except having a double inverted conical through hole such as in the embodiments illustrated by FIGS. 6A and 6B had a frequency separation of 600 MHz. Particularly, the fundamental TE mode was centered at 1,033 MHz while the first hybrid mode, (the $H_{12\delta}$ mode in this simulation) was centered at approximately 1624 MHz. Accordingly, the frequency separation was increased from approximately 350 MHz to approximately 600 MHz. See simulation results in Appendix, pages 1-2.

Appendix A hereto contains the data from the afore-described simulations.

As previously mentioned, the present invention does not significantly affect coupling performance between resonators. Accordingly, while the present invention has significant advantages with respect to spurious response when used in connection with cylindrical resonators, it does not, per se, solve the poor coupling problem inherent in cylindrical resonator circuits. Conical resonators, on the other hand, provide greatly enhanced ability to couple fields between adjacent resonators (or between a resonator and other circuitry, such as an input or output coupling loop). The variable cross-section through hole concept of the present invention provides the different advantage of improved frequency spacing between the fundamental mode and spurious modes. Accordingly, by combining these two features, one can create extremely high performance dielectric resonator circuits. Designing such a circuit so that the positions of the conical resonators relative to each other can be adjusted in order to regulate coupling between them and, therefore, bandwidth of the circuit provides an even more useful circuit.

However, with respect to cylindrical resonators, we have discovered ways to improve coupling between such resonators.

Figure 10B:
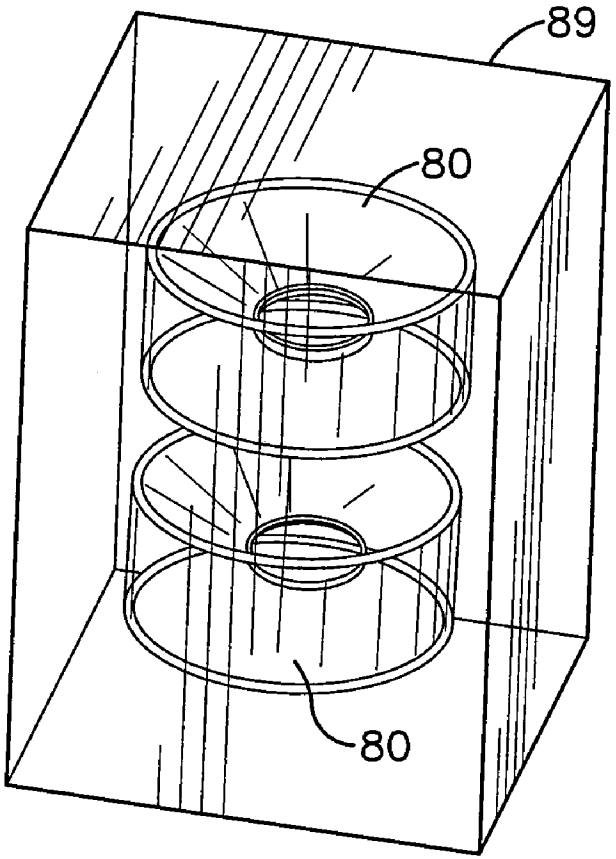
FIGS. 10A and 10B are transparent side and perspective views, respectively, of a coupling layout for another 2 pole dielectric resonator circuit in accordance with a particular embodiment the present invention.
Figure 10A:
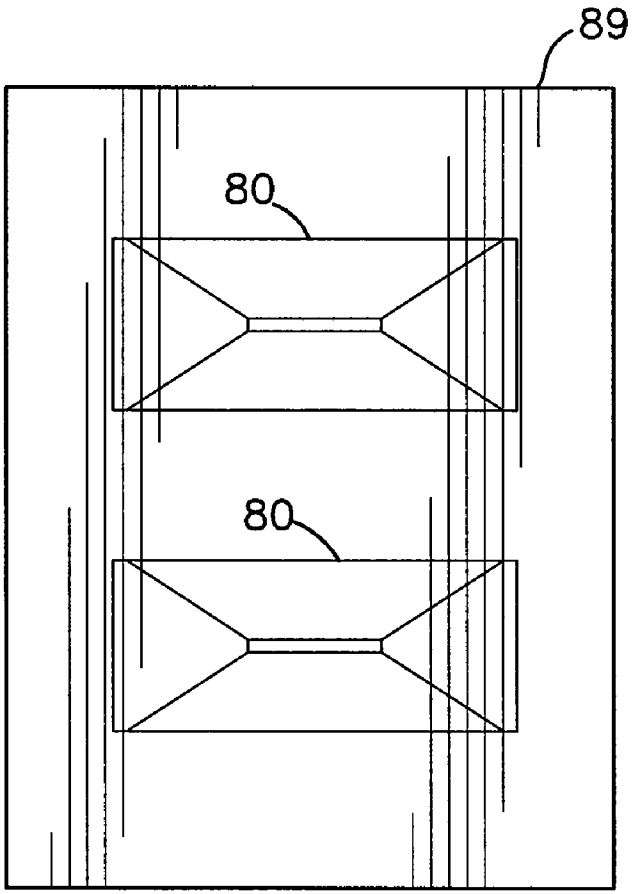
Figure 11B:
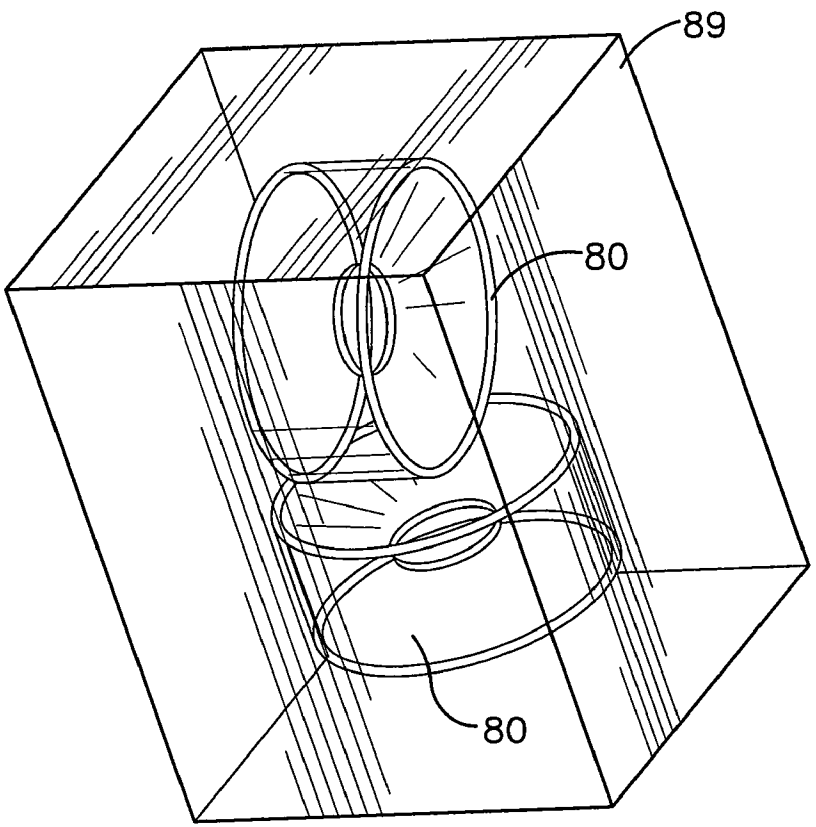
FIGS. 11A and 11B are transparent side and perspective views, respectively, of a coupling layout for another 2 pole dielectric resonator circuit in accordance with another particular embodiment the present invention.
Figure 11A:
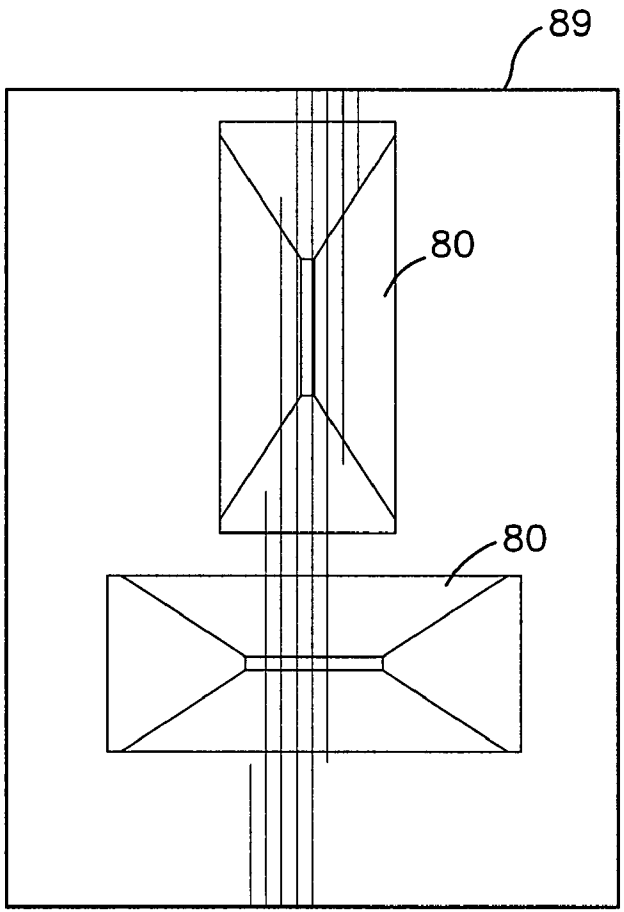

FIGS. 10A and 10B are side and perspective views, respectively, of a two pole dielectric resonator circuit layout in which two resonators 80 (in this case, cylindrical resonators generally in accordance with the embodiment illustrated in FIGS. 8A and 8B) are arranged coaxially within an enclosure 89. FIGS. 11A and 11B illustrate the same circuit (comprising resonators 80 and enclosure 89), but with one of the resonators 80 rotated 90° about its geometric center so that the longitudinal axes of the two resonators in the circuit are now perpendicular to each other. Simulations show that the coupling between the two resonators 80 when oriented coaxially such as illustrated in FIGS. 10A and 10B is 41 MHz, whereas the coupling between the two resonators 80 when oriented orthogonally as shown in FIGS. 11A and 11B is reduced to 17 MHz. Accordingly, it appears that stronger coupling is achieved when the resonators are arranged coaxially relative to each other.

Figure 12A:
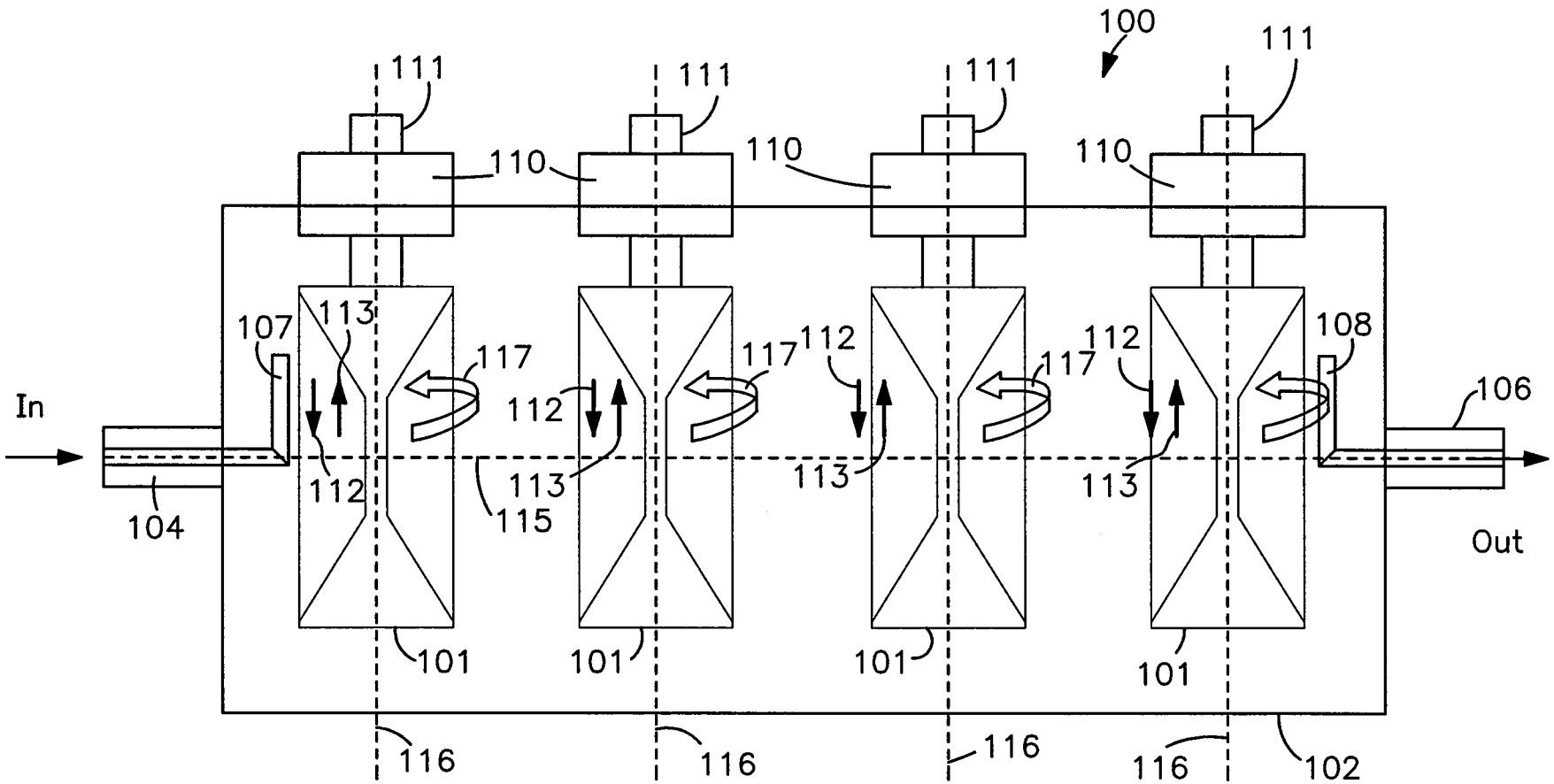
FIGS. 12A and 12B are transparent side and perspective views, respectively, of a coupling layout for a 4 pole dielectric resonator circuit in accordance with a particular embodiment the present invention.
Figure 12B:
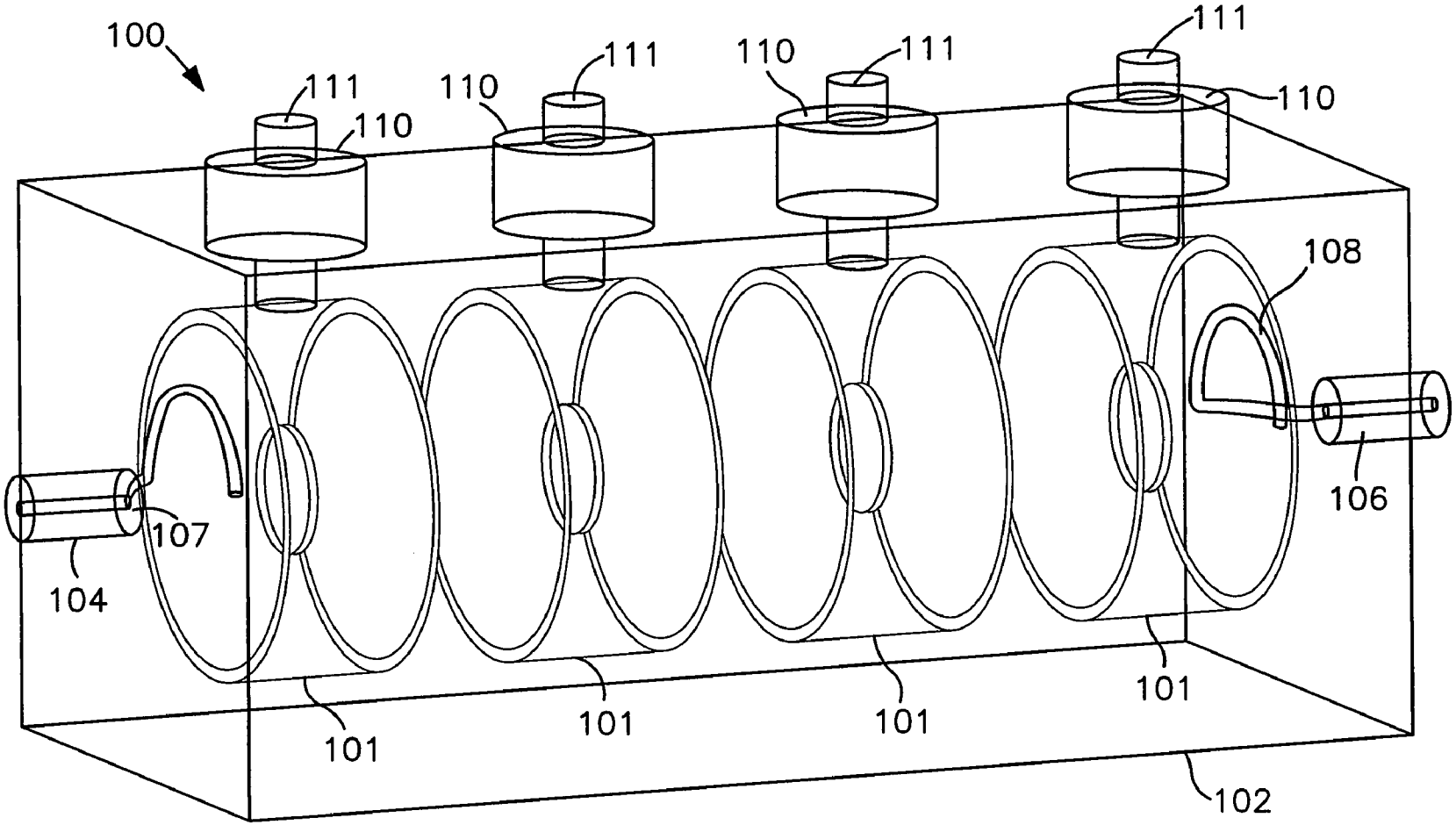

FIGS. 12A and 12B are transparent side and perspective views, respectively, of a four pole dielectric resonator filter circuit 100 in accordance with one particular advantageous embodiment of the invention. The circuit 100 comprises an enclosure 102 containing four cylindrical dielectric resonators 101. The resonators are cylindrical resonators having a through hole comprising two inverted conical sections joined by a small cylindrical section at their apexes, such as illustrated in FIGS. 8A and 8B. The resonators 101 are arranged so that a single line 115 intersects the geometric center of each resonator.

The circuit includes an input coupler 107 that receives a signal from an input coaxial cable 104 and an output coupler 108 that provides an output signal through an output coaxial cable 106.

A circular tuning plate 110 is positioned adjacent to each dielectric resonator 101, each passing through an opening in the wall of the enclosure 102. The tuning plates 110 may be externally threaded while the holes in the enclosure through which they extend are internally threaded so that the tuning plates 110 can be rotated in those holes to affect movement of them in the direction of arrows 112, 113 in FIG. 12A. Mounting pins 111 pass through holes in the longitudinal centers of the tuning plates 110 and are attached to the side walls of the resonators 101. The mounting pins 111 are rotatable relative to the tuning plates 110 through which they pass and thus can be used to rotate the resonators 101 relative to each other about axes 117. For example, the mounting pins may be externally threaded and mate with mating threads on the holes in the tuning plates.

The above described embodiment illustrates merely one possible technique for mounting the resonators to the enclosure so that the resonators can be rotated relative to each other so that they can be arranged coaxially and adjusted therefrom. The resonator mounting pins need not be threadedly engaged with the tuning plate and, instead, may have any form of rotatable joint where it mates to the resonator, the enclosure or anywhere else along its length. Furthermore, while the illustrated embodiment is particularly elegant, the mounting pin can be entirely separate from the tuning plate. Preferably the longitudinal axes of the mounting pins are all oriented perpendicularly to the line connecting the geometric centers of the resonators. Preferably, the longitudinal axes of the tuning plates and the mounting pins are parallel to each other. They may be coaxial with each other, as exemplified by FIGS. 12A and 12B. Alternately, they may be coaxial, but mounted on opposite sides of the enclosure.

Having thus described a few particular embodiments of the invention, various alterations, modifications, and improvements will readily occur to those skilled in the art. Such alterations, modifications, and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

We claim:

1. A dielectric resonator comprising a body formed of a dielectric material, said body having a longitudinal direction and including a through hole in said longitudinal direction, said through hole varying in cross-sectional area perpendicular to said longitudinal direction as a function of said longitudinal direction, said longitudinal through hole adapted such that said body has dielectric material in a volume where a substantial portion of a field of a fundamental mode would exist in response to electromagnetic excitation of said dielectric resonator and provides open space where a substantial portion of a field of at least one spurious mode would exist in response to excitation of said dielectric resonator.

2. The dielectric resonator of claim 1 wherein said fundamental mode is a transverse electric (TE) mode and said at least one spurious mode comprises an $H_{11}$ mode.

3. The dielectric resonator of claim 1 wherein said through hole comprises a conical portion having a larger longitudinal end and a smaller longitudinal end.

4. The dielectric resonator of claim 1 wherein said through hole comprises a first and second conical portions, said first and second conical portions being inverted relative to each other, wherein said first and second conical portions increase in cross-section as they approach the longitudinal ends of said resonator body.

5. The dielectric resonator of claim 4 wherein said resonator body comprises a truncated conical portion having a larger longitudinal end and a smaller longitudinal end.

6. The dielectric resonator of claim 5 wherein said resonator body further comprises a cylindrical portion adjoining said larger longitudinal end of said conical portion of said resonator body.

7. The dielectric resonator of claim 6 wherein said though hole further comprises a cylindrical portion and said first and second conical portions of said through hole are joined by said cylindrical portion of said through hole.

8. The dielectric resonator of claim 5 and wherein said resonator body further comprises a cylindrical portion adjoining said larger longitudinal end of said conical portion.

9. The dielectric resonator of claim 4 wherein said though hole further comprises a cylindrical portion and said first and second conical portions of said through hole are joined by said cylindrical portion of said through hole.

10. The dielectric resonator of claim 4 wherein said resonator body is cylindrical.

11. The dielectric resonator of claim 1 wherein said fundamental mode is a transverse electric (TE) mode and said at least one spurious mode comprises a TM mode.

12. The dielectric resonator of claim 1 wherein said fundamental mode is a transverse electric (TE) mode and said at least one spurious mode comprises a TM mode and an $H_{11}$ mode.

13. The dielectric resonator of claim 1 wherein said through hole comprises a first portion having a first cross section, a second portion having a second cross section, and a third portion having a third cross section and wherein said first and third cross sections are larger than said second cross section and further wherein said first and third portions of said through hole are positioned adjacent opposite longitudinal ends of said resonator body, respectively, and said second portion of said through hole joins said first and third portions of said through hole.

14. The dielectric resonator of claim 13 wherein said resonator body comprises a truncated conical portion having a smaller longitudinal end and a larger longitudinal end.

15. The dielectric resonator of claim 13 wherein said resonator body comprises a cylinder.

16. The dielectric resonator of claim 1 wherein said resonator body comprises a truncated conical portion having a smaller longitudinal end and a larger longitudinal end, and wherein said through hole comprises a cylindrical portion and a conical portion, wherein said cylindrical portion of said through hole is positioned adjacent said larger longitudinal end of said resonator body and said conical portion of said through hole is positioned adjacent said smaller end of said resonator body, said conical portion of said through hole being inverted relative to said conical portion of said resonator body.

17. The dielectric resonator of claim 1 wherein said dielectric resonator body comprises a truncated conical portion having a smaller longitudinal end and a larger longitudinal end, and wherein said through hole comprises a first portion having a first cross section, a second portion having a second cross section larger than said first cross section and a third portion having a third cross section larger than said first cross section, said second and third portions positioned adjacent said longitudinal ends of said dielectric resonator body, respectively, and said first portion positioned intermediate said second and third portions.

18. The dielectric resonator of claim 17 wherein said dielectric resonator body further comprises a cylindrical portion adjoining said larger longitudinal end of said conical portion, and wherein said third portion of said through hole is in said conical portion of said dielectric resonator body.

19. The dielectric resonator of claim 18 wherein said second and third portions of said through hole have the same cross section.

20. The dielectric resonator of claim 1 wherein said through hole comprises a stepped cylindrical through hole.

21. The dielectric resonator of claim 20 wherein said dielectric resonator body comprises a truncated conical portion having a smaller longitudinal end and a larger longitudinal end, and wherein said stepped cylindrical through hole comprises a first portion having a first cross section and a second portion having a second cross section larger than said first cross section, said second portion positioned adjacent said smaller longitudinal end and said first portion positioned adjacent said larger longitudinal end.

22. The dielectric resonator of claim 21 wherein said dielectric resonator body further comprises a cylindrical portion adjoining said larger longitudinal end of said conical portion.

23. The dielectric resonator of claim 20 wherein said dielectric resonator body is cylindrical having first and second longitudinal ends, and wherein said stepped cylindrical through hole comprises a first portion having a first cross section, a second portion having a second cross section larger than said first cross section and a third portion having a third cross section larger than said first cross section, said second and third portions positioned adjacent said longitudinal ends of said dielectric resonator body, respectively, and said first portion positioned adjacent intermediate said second and third portions.

24. The dielectric resonator of claim 20 wherein said stepped cylindrical through hole comprises a first portion having a first cross section, a second portion having a second cross section larger than said first cross section, and a third portion having a third cross section larger than said first cross section, said second portion positioned adjacent said smaller longitudinal end, said third portion positioned adjacent said larger longitudinal end, and said first portion positioned between said second and third portions.

25. The dielectric resonator of claim 24 wherein said dielectric resonator body further comprises a cylindrical portion adjoining said larger longitudinal end of said conical portion and said third portion of said through hole is disposed in said cylindrical portion of said dielectric resonator body.

26. The dielectric resonator of claim 1 wherein said dielectric resonator body comprises an outer surface and an inner surface, said inner surface being a surface defined by said longitudinal through hole, and wherein said outer surface and said inner surface are not covered by a conductor.

27. A dielectric resonator circuit comprising:

a plurality of dielectric resonators, each resonator comprising a body formed of the dielectric material, said body including a longitudinal through hole, said through hole varying in cross-sectional area perpendicular to said longitudinal direction as a function of said longitudinal direction, said longitudinal through hole adapted such that said body has dielectric material in a volume where a substantial portion of a field of a fundamental mode would exist in response to electromagnetic excitation of said dielectric resonator and provides open space where a substantial portion of a field of at least one spurious mode would exist in response to excitation of said dielectric resonator;

an enclosure containing said dielectric resonators:

an input coupler:

an output coupler:

wherein at least one of said dielectric resonators is mounted to said enclosure so as to be rotatable relative to another of said dielectric resonators about an axis perpendicular to longitudinal axis of said at least one dielectric resonator.

28. A dielectric resonator circuit comprising:

a plurality of dielectric resonators, each resonator comprising a body formed of the dielectric material, said body including a longitudinal through hole, said through hole varying in cross-sectional area perpendicular to said longitudinal direction as a function of said longitudinal direction, said longitudinal through hole adapted such that said body has dielectric material in a volume where a substantial portion of a field of a fundamental mode would exist in response to electromagnetic excitation of said dielectric resonator and provides open space where a substantial portion of a field of at least one spurious mode would exist in response to excitation of said dielectric resonator and wherein said dielectric resonators are arranged relative to each other so that the geometric centers of said dielectric resonators are on a single line:

an enclosure containing said dielectric resonators:

an input coupler:

an output coupler:

a pin mounting each dielectric resonator on said enclosure, each said pin having a first portion coupled to said enclosure and a second portion coupled to a corresponding dielectric resonator, each said pin having a longitudinal axis perpendicular to and intersecting said single line, all of said pins parallel to each other, and wherein said pins are rotatable about their longitudinal axes relative to at least one of said enclosure and said corresponding dielectric resonator.

* * * * *